US005085162A

United States Patent [19]

Petrich

[11] Patent Number: 5,085,162

[45] Date of Patent: Feb. 4, 1992

[54] UNITARY SELF-SUPPORTING WOOD DECK INSERT FOR BOATS

[75] Inventor: John P. Petrich, Tacoma, Wash.

[73] Assignee: The Trust of John P. Petrich, Tacoma, Wash.

[21] Appl. No.: 583,507

[22] Filed: Sep. 17, 1990

[51] Int. Cl.[5] ..... B63B 3/48

[52] U.S. Cl. ..... 114/85; 114/355; 114/357; 114/358

[58] Field of Search ..... 114/85, 355, 357, 358

[56] References Cited

U.S. PATENT DOCUMENTS

| | | | |
|---|---|---|---|
| 250,717 | 12/1881 | Durant | 114/358 |
| 1,992,711 | 2/1935 | Mead | 114/355 |
| 2,503,603 | 4/1950 | Wiley | 114/85 |
| 2,758,321 | 8/1956 | Westfall . | |
| 3,076,204 | 2/1963 | Nowak, Jr. . | |
| 3,092,850 | 6/1963 | Klopstock et al. | 114/358 |
| 3,372,408 | 3/1968 | Luger et al. | 114/357 |
| 3,831,212 | 8/1974 | Moore et al. . | |
| 4,120,749 | 10/1978 | Humphrey | 114/357 |

FOREIGN PATENT DOCUMENTS 240298 10/1987 European Pat. Off. ..... 114/85

OTHER PUBLICATIONS

"Penn Yan Phantom Sailer" in Penn Yan Boats, pp. 18 and 19, published 1937.

"Popular Science", Mar. 1956, pp. 113–119.

"Science and Mechanics", Dec. 1951, pp. 153–159.

*Primary Examiner*—Sherman Basinger

*Assistant Examiner*—Thomas J. Brahan

*Attorney, Agent, or Firm*—Jensen & Puntigam

[57] ABSTRACT

The unitary deck insert (10) includes two longitudinal plank braces (14,16) which extend the entire length of the deck insert (10), and two beam members (20,22) which extend laterally across the deck insert. A portion of the respective lengths of the longitudinal planks (14, 16) and the beam members (20, 22) define an open cockpit area for the deck insert (10). Deck planks (13) extend outboard of plank braces (14, 16) as well as between the plank braces (14, 16) at the fore and aft ends of the deck insert (10), thereby defining the deck itself. The boundary edge of the deck insert (10) is notched to mate with the top edge of the hull (12).

8 Claims, 2 Drawing Sheets

FIG. 3
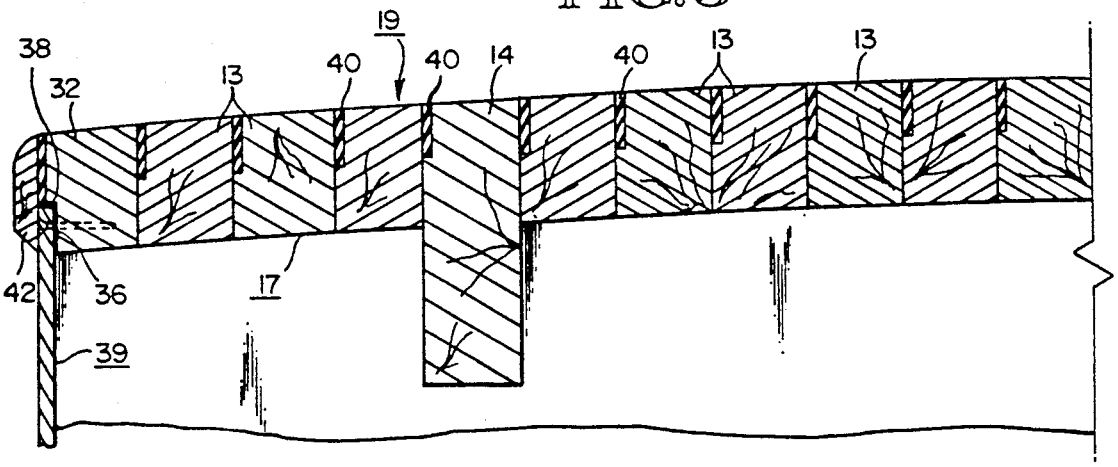
FIG. 4
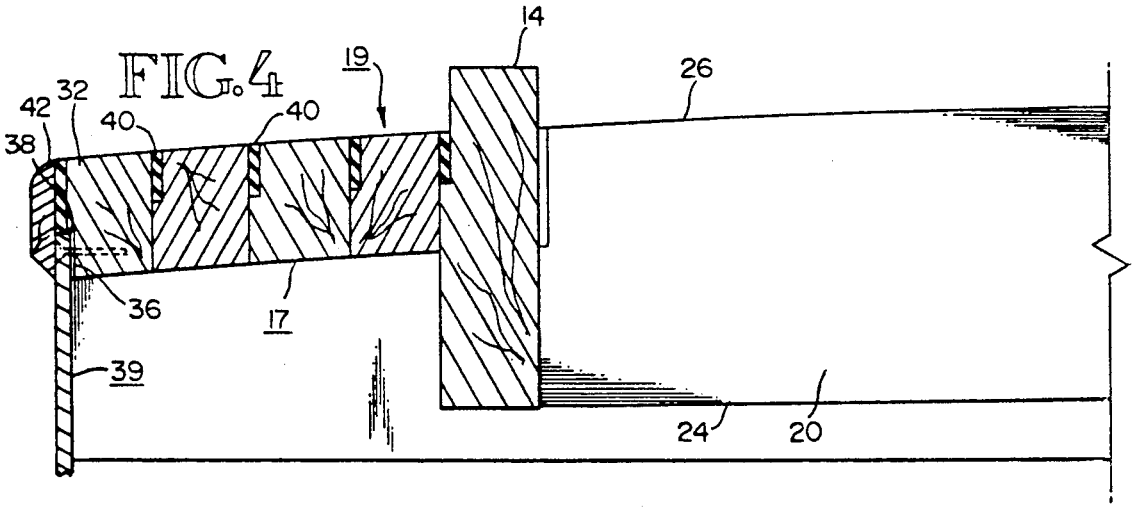
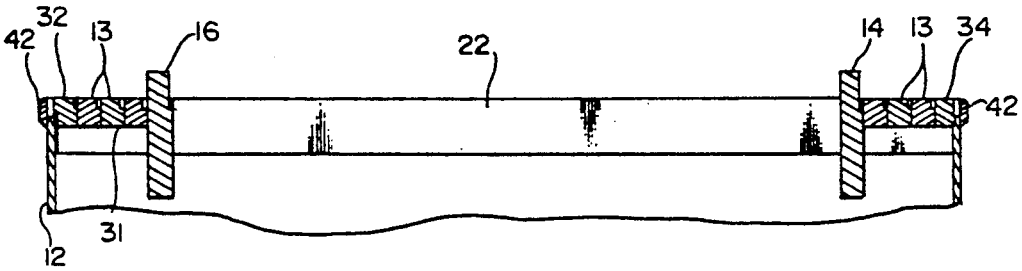
FIG. 5

UNITARY SELF-SUPPORTING WOOD DECK INSERT FOR BOATS

DESCRIPTION

1. Technical Field

This invention relates generally to the art of boat construction and more specifically concerns a particular structural arrangement for a deck portion of a boat.

2. Background Art

Historically, there has been and still is, a great appeal in the appearance of a wooden boat. The appreciation for wooden boats includes a particular type of boat generally referred to as a "runabout" which refers to a boat typically between 10 and 30 feet long, having an extended open cockpit and a flat or slightly canted wooden deck surrounding the open cockpit. Typically, there is no cabin superstructure on such a boat; the deck extends for a considerable distance beyond the forward end of the cockpit, with relatively little deck area to the sides and rear of the cockpit.

While the runabout design as well as other similar designs of wood boats are appealing because of their classic appearance, such boats are very expensive due to their wooden construction, as well as being quite expensive and time consuming to maintain.

On the other hand, similar boat designs have been implemented using modern fiberglass construction techniques. Fiberglass boats have the advantage of a significant reduction in cost relative to a wooden boat while retaining the same basic classic configuration. Cost for maintenance is also typically considerably reduced for a fiberglass boat. However, while a particular fiberglass boat may have the same configuration as a wooden boat, it does not have the classic appearance of a natural wood boat, particularly those wood boats having decks of polished natural wood, such as mahogany. Some boat designs, such as that shown in U.S. Pat. No. 2,758,321, use wood members in the hull, which does not improve the exterior appearance of the boat, while still other designs have utilized wood to some extent for exterior portions of a boat, such as in guard rails. In still other designs, fiberglass or other plastic material is applied in layers over a wooden substructure. Such techniques may decrease maintenance requirements, but may not significantly reduce the cost of the boat.

DISCLOSURE OF THE INVENTION

Accordingly, the present invention is a self-supporting unitary deck insert for boats, which includes two longitudinal wooden plank braces which extend substantially the length of the deck insert, defining over a portion of their respective lengths the longitudinal boundaries of an open cockpit area for the boat. The insert further includes forward and rear wooden beam members which extend laterally across the deck insert between the plank braces, defining over at least a portion of their respective lengths the front and rear boundaries of the cockpit. The insert further includes first, second, third and fourth pluralities of wooden deck planks. The first and second pluralities of planks each comprise a group of planks secured together along their longitudinal sides, extending respectively outboard of the two plank braces and fore and aft of the beam members, thereby defining the portions of the deck insert which are laterally outboard of the cockpit. The third plurality of wooden deck planks are secured together along their respective longitudinal sides and extend between the plank braces forward of the forward beam member, thereby defining the forward portion of the deck insert. The fourth plurality of wooden deck planks are secured together along their respective longitudinal sides and extend between the longitudinal plank braces to the rear of the rear beam member, thereby defining the aft portion of the deck insert, wherein the deck insert has a boundary edge which is configured to mate with the top edge of a boat hull, the deck insert being thereby supported by the hull.

BRIEF DESCRIPTION OF THE DRAWINGS

FIG. 3 is a cross-sectional view taken along lines 3—3 in FIG. 1.

FIG. 4 is a cross-sectional view taken along lines 4—4 in FIG. 1.

FIG. 5 is a cross-sectional view taken along lines 5—5 in FIG. 1.

BEST MODE FOR CARRYING OUT THE INVENTION

Figure 1:
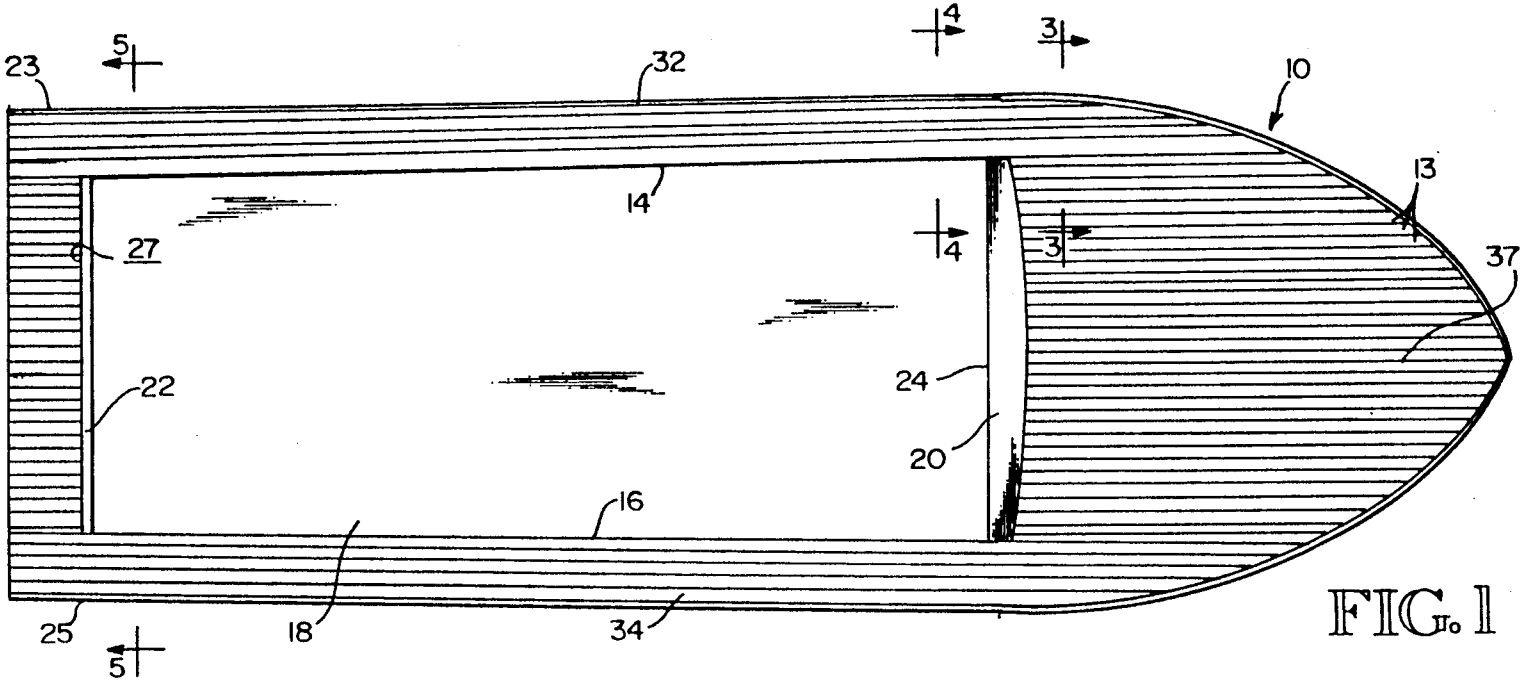
FIG. 1 is a plan view of the wooden deck boat insert of the present invention.
Figure 2:
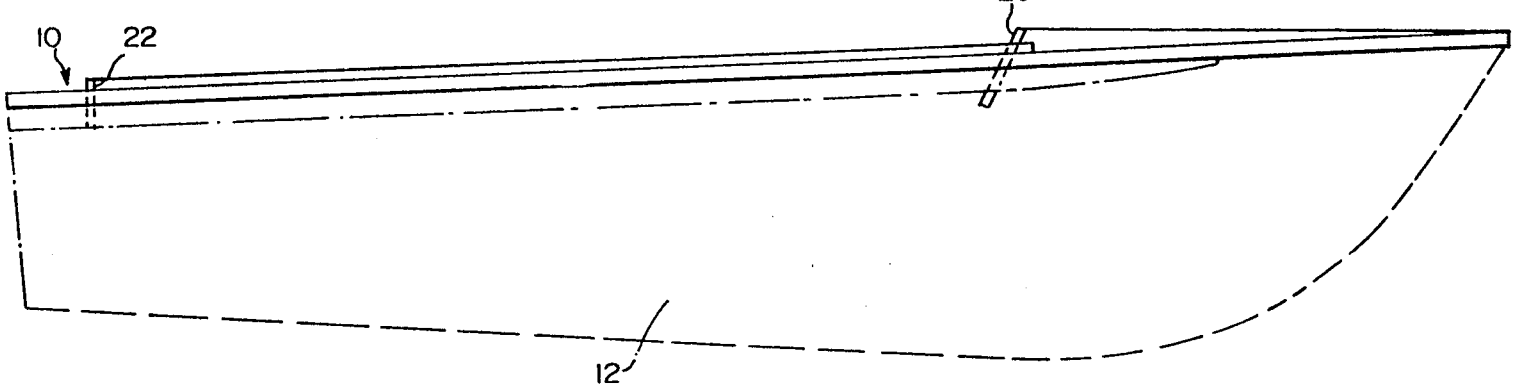
FIG. 2 is an elevational view of the invention shown in FIG. 1.

FIGS. 1 and 2 illustrate the unitary self-supporting deck insert of the present invention. The deck insert, shown generally at 10, is constructed and arranged in a manner described in detail hereinafter for direct connection to a fiberglass hull shown generally at 12, without any need for reinforcing spars, joists or jibs to support or connect the deck to the hull. The hull 12 is a conventional fiberglass hull manufactured using conventional fiberglass techniques and having a desired configuration and size. Typically, the hull will be manufactured using a commercially available mold, to reduce expense. The hull 12 in the particular embodiment described herein has the general configuration shown, with a length of 21 feet, a width of 8 feet, and a height which varies as shown from 3 feet at the aft end of the boat to a maximum height of 3 feet 6 inches near the fore end of the boat. The hull 12 could have other configurations and can vary dimensionally. Also, the hull could be manufactured using layering techniques, or it could be a hull from an existing boat, perhaps even a wooden boat, in which case the deck insert of the present invention is used essentially as a retrofit.

The self-supporting deck insert 10 comprises a plurality of hardwood (e.g. mahogany) planks 13, with most of the planks in the embodiment shown being approximately 2 inches wide and 2 ¾ inches high (thick). The width of the planks 13 can vary substantially, i.e. from 1 ½ to 3 inches as an example. The planks 13 are arranged in a particular manner to form the self-supporting unitary deck insert 10. Two interior planks 14 and 16 extend the entire length of the boat and over a portion of their respective lengths define the longitudinal boundaries of the open cockpit area shown at 18. These two longitudinal interior planks 14 and 16, referred to as plank braces, serve as braces for and help to provide the structural integrity for the entire deck insert, and have a substantially greater height than the other plank members. This is most clearly seen in FIGS. 3 and 4, where plank braces 14 and 16 extend approximately 6 inches below the bottom surface 17 of the other plank members. Further, over the portion of their respective lengths which define the longitudinal boundaries of the cockpit 18, plank braces 14 and 16 extend approximately 1 inch above the upper surface 19 of the other plank members 13, thereby serving as a splash guard for the cockpit 18. Typically, the upper surface of plank braces 14 and 16 will taper so that, at the rear of the cockpit area 18, the upper surface of planks 14 and 16 will be flush with the upper surface of the other planks 13.

Extending laterally across the deck insert 10 are two beam members 20 and 22. Beam member 20 defines the forward end of the cockpit 18 and extends in the embodiment shown between the interior plank braces 14 and 16, although it could extend the full width of the deck 10 to both longitudinal edges 23 and 25 (FIG. 1) of deck 10. Beam 20 in the embodiment shown is a solid board approximately 2 inches thick with a lower edge 24 which is flat between its opposing ends. Upper edge 26 is curved between the opposing ends of the beam, to conform as shown to the outline of the deck 10 as it curves from one longitudinal side to the other, as partially shown in FIGS. 3 and 4.

Beam 22 defines the rear end of the cockpit 18. In the embodiment shown, beam 22 extends the full width of the deck. Beam 22 is approximately 2 inches thick and is approximately 7 inches high between plank braces 14 and 16. Plank braces 14 and 16 are notched to fit over and partially around beam member 22. Beam member 22 is cut out, i.e. its height decreased, from plank braces 14 and 16 to the edges of the deck insert 10. The amount of the height decrease is equal to the thickness (height) of planks 13, so that planks 13 outboard of plank braces 14 and 16 extend over and rest upon the upper surface 31 of beam member 22, as shown in FIG. 5. The upper surfaces of the planks 13 outboard of plank braces 14 and 16 are thus coplanar with the upper surface of beam member 22 between plank braces 14 and 16. Alternatively, beam 22 could extend just between plank braces 14 and 16.

Plank braces 14 and 16 and beam members 20 and 22 provide supporting integrity for the deck 10 as a whole as well as defining the configuration of cockpit 18. Individual planks 13 are then positioned successively outboard of plank braces 14 and 16 to the edge of the deck 10. In the embodiment shown, there are four planks outboard of each plank brace 14 and 16. However, this number may vary, depending upon the desired configuration of the deck. Extending between plank braces 14 and 16 forward of beam 20 is a forward plank array comprised of a plurality of individual planks 13 secured together laterally across the deck. The front end of each plank 13 is contoured so as to give the traditional bow appearance as shown in FIG. 1. In the embodiment shown, the forward plank array comprises a total of 32 separate planks, although this number can vary significantly, depending upon the dimensions of the finished deck.

In one mode of construction, the forward plank array can be constructed as a separate unit, and then secured as a unit to plank braces 14 and 16 and the forward surface of beam 20. Typically, but not necessarily, planks 13 will be canted somewhat, so that the upper surface of the deck 10 forward of the cockpit 18 will curve somewhat from side to side, with a high point typically being along the centerline of the deck. In one example, the upper surface of the forward portion of the deck 10 at centerline 37 is approximately 3 ¼ inches higher than at the edges of the deck.

An aft plank array extends between plank braces 14 and 16 and from the rear of beam member 22. The rear end of the aft plank array and the rear end of plank braces 14 and 16 and planks 13 which are outboard from plank braces 14, 16 define the stern of the deck. The front end of the aft plank array shown in FIG. 1 abuts the rear surface 27 of beam 22, so that the top surface of each plank 13 in the aft plank array is flush with the top edge/surface of beam 22. In the embodiment shown, the aft plank array comprises 29 separate planks, but this may of course be varied significantly. The planks 13 comprising the aft plank array may be secured together in one unit and then positioned in place between plank braces 14 and 16 and against the rear surface of beam 22. The aft plank array will have various configurations, depending upon whether the boat configuration is for an outboard motor, an inboard/outboard or an inboard. The deck insert of the present invention is applicable in all three configurations.

The planks 13 comprising the deck 10 may be secured together in a number of ways. In the embodiment shown, each plank 13 is secured with marine glue to adjacent planks, and screws are used to attach adjacent planks together Typically, a screw is used every 1 ½ feet at the interface between adjacent planks, with the screws being arranged so as to alternate between the two longitudinal sides of each plank along the length thereof. Also, bisquit joints are used typically to hold the planks in place prior to insertion of the screws. This arrangement results in a very secure and stable deck structure.

The most outboard planks 32 and 34 have a notch 36 in the lower portion of the outboard edge thereof. This is shown most clearly in FIG. 3 and 4. The top edge 38 of the hull 12 fits into the notch 36, so that the edge of deck 10 rests on the top edge 38. The front planks 13, including planks 32 and 34, are notched to provide similar contact with the hull 12 at the forward end of the deck. The rear edges of planks 13 at the aft end of the deck are also notched in similar fashion. Hence, deck 10 is notched around its entire boundary, designed to fit against the top edge of hull 12 and a small portion of the interior surface 39 of the hull, as shown most clearly in FIGS. 3 and 4. Glue is used between the planks and the hull where they mate together and screws are driven through the hull 12 into the most outboard planks 32 and 34 along the length thereof to provide secure attachment between the deck insert 10 and the hull 12.

The particular arrangement and construction of deck 10 described above provides the necessary structural integrity for the deck insert 10 while still being adequately supportable by the top edge of the hull 12 without any additional joists or jibs.

Referring now to FIGS. 3 and 4 in particular, an upper portion of one of the longitudinal side edges of each plank 13 is relieved or notched, as shown at 40. In the embodiment shown, notch 40 is approximately 1 ¾ inches high from top to bottom and approximately ¼ inch thick, so that when the individual planks 13 are secured together by the above-described glue and screws, there are gaps showing between adjacent planks when the deck 10 is viewed from above. These gaps are then filled in with a white epoxy resin which provides a contrast with the natural wood of the planks 13. This accentuates the appearance of the individual plank construction and while not necessary to the present invention enhances the final appearance of the deck insert 10.

The entire deck 10 is then finished in conventional fashion, by staining, varnishing, etc. to give the desired final appearance. Finally, a facing member or guard 42, approximately ½ inch thick, is secured around the edge of the boat, the top edge thereof flush with the top surface of the deck 10 and extending downwardly, overlapping slightly the top edge of the hull 12. The guard 42 gives a finished appearance to the overall boat structure.

Thus, a wooden deck insert has been described and shown which is unitary, self-supporting and can be directly mounted to an existing fiberglass hull. One advantage of the present invention is that the appearance of the traditional wooden runabout boat with its long forward deck can be obtained in combination with a conventional fiberglass hull without any significant modification thereof, thereby retaining the advantage of the fiberglass hull for its relative ease of maintenance and relatively low expense. The deck insert may be used with new hulls of various configurations and construction or may be used as a retrofit for existing hulls. Further, the deck itself could be fairly flat, as shown, or could include a limited superstructure, such as a flying bridge. Although a preferred embodiment of the invention has been disclosed herein for illustration, it should be understood that various changes, modifications and substitutions may be incorporated in such embodiment without departing from the spirit of the invention, as defined by the claims which follow.

I claim:

1. A self-supporting unitary wooden deck insert for power boats with fiberglass hulls, comprising:

two longitudinal wooden plank braces which extend substantially the length of the deck insert, defining over a portion of their length the longitudinal boundaries of an open cockpit area for the boat;

forward and rear wooden beam members which extend laterally across the deck insert between the plank braces, defining over at least a portion of their lengths the front and rear boundaries of the cockpit;

first and second pluralities of wooden deck planks, secured together along their respective longitudinal sides, extending respectively outboard of the two plank braces and fore and aft of the beam members, thereby defining the portions of the deck insert which are laterally outboard of the cockpit;

a third plurality of wooden deck planks, secured together along their respective longitudinal sides and extending between the plank braces forward of the forward beam member, thereby defining the forward portion of the deck insert; and a fourth plurality of wooden deck planks, secured together along their respective longitudinal sides and extending between the longitudinal plank braces to the rear of the rear beam member, thereby defining the aft portion of the deck insert, wherein the deck insert has a boundary edge which is configured to mate with the top edge of a fiberglass boat hull for attachment thereto, the deck insert being thereby supported by the top edge of the hull, wherein the deck insert is otherwise characterized by the absence of spars or other support frame members.

2. An article of claim 1, wherein the deck insert is curved in lateral cross section forward of the cockpit.

3. An article of claim 1, wherein the rear beam member extends the entire width of the deck insert.

4. An article of claim 1, wherein the portion of the length of each plank brace defining the cockpit is slightly raised with respect to adjacent deck planks, thereby defining a splash guard for the cockpit.

5. An article of claim 1, wherein at least one side of the deck planks is slightly notched at the upper surface edge thereof, thereby leaving a gap between adjacent deck planks, and wherein said gap is filled by epoxy resin.

6. An article of claim 1, wherein the deck planks are secured together by glue and screws, and wherein the first and second pluralities of deck planks are secured to the plank braces and wherein the third and fourth pluralities of deck planks are secured to the plank braces and, respectively, to the forward and rear beam members and wherein the boundary edge of the deck insert is notched to fit against and partially around a top edge portion of the hull and is secured thereto by glue and screws.

7. An article of claim 6, including a wooden facing member which extends along the boundary edge of the deck insert, wherein the facing member has a top edge which is flush with the top surface of the deck insert and wherein the facing member overlaps a small portion of the upper part of the hull, providing an integral finished appearance for the deck insert and the hull.

8. An article of claim 1, wherein the longitudinal plank braces have upper surfaces which are in the same plane as the upper surfaces of the third plurality of wooden deck planks over the forward portion of the deck insert and wherein the upper surfaces of the longitudinal plank braces are in the same plane as the upper surfaces of the fourth plurality of wooden deck members over the aft portion of the deck insert.

* * * * *